United States Patent [19]

Grabbe et al.

[11] 4,370,017

[45] Jan. 25, 1983

[54] COMPLANATE CONTACT TERMINAL

[75] Inventors: Dimitry G. Grabbe, Lisbon Falls, Me.; Iosif Korsunsky, Harrisburg, Pa.

[73] Assignee: AMP Incorporated, Harrisburg, Pa.

[21] Appl. No.: 208,724

[22] Filed: Nov. 20, 1980

[51] Int. Cl.[3] ..... H01R 13/02

[52] U.S. Cl. ..... 339/176 MP; 339/252 R

[58] Field of Search ..... 339/17 CF, 17 LM, 17 M, 339/75 M, 75 MP, 176 MP, 252 R

[56] References Cited

U.S. PATENT DOCUMENTS

| | | | |
|---|---|---|---|
| 3,016,508 | 1/1962 | Lalonde | 339/176 MP |
| 3,120,988 | 2/1964 | Gilbert | 339/176 MP |
| 3,199,066 | 8/1965 | Eledge et al. | 339/176 MP |
| 3,631,381 | 12/1971 | Pittman | 339/176 MP |
| 3,871,736 | 3/1975 | Carter | 339/17 CF |
| 4,050,755 | 9/1977 | Hasircoglu | 339/17 CF |
| 4,176,895 | 12/1979 | Aldridge | 339/17 CF |
| 4,188,085 | 2/1980 | Aldridge et al. | 339/17 CF |
| 4,268,102 | 5/1981 | Grabbe | 339/75 M |

FOREIGN PATENT DOCUMENTS

| | | | |
|---|---|---|---|
| 2106178 | 11/1971 | Fed. Rep. of Germany | 339/252 R |
| 1013151 | 12/1965 | United Kingdom | 339/176 MP |

*Primary Examiner*—John McQuade

*Attorney, Agent, or Firm*—Frederick W. Raring

[57] ABSTRACT

An electrical contact terminal of the type contained in a connector housing comprises a yoke portion having extending therefrom a contact arm and a spring arm. The contact arm has an electrical contact portion on one side thereof and a bearing portion on the other side which bears against a bearing portion on the spring arm. When the contact arm is flexed toward the spring arm by a mating part, such as a circuit board, the contact force is developed in the spring arm and the contact arm serves primarily as a conductor. The terminal is of the complanate type in that it is produced by stamping sheet metal without subsequent bending, so that all parts of the terminal lie in the plane of the sheet metal from which it was produced.

10 Claims, 10 Drawing Figures

COMPLANATE CONTACT TERMINAL

FIELD OF THE INVENTION

This invention relates to multi-contact electrical connectors and to improved contact terminals for such connectors. Contact terminals in accordance with the invention are produced by stamping sheet metal without forming, so that they are extremely thin and have structural features which result in a terminal having extremely low self-inductance.

BACKGROUND OF THE INVENTION

Electrical contact terminals of the type used in multi-contact electrical connectors for circuit boards or other substrates are usually manufactured from sheet metal by stamping a flat blank from the sheet metal and then forming or bending the blank to produce the desired final configuration in the terminal including a contact portion and a suitable spring for developing the required contact force when the connector is mated with a circuit board or the like. An alternative type of contact terminal may be produced by simply stamping the sheet metal stock without forming in a manner such that the finished terminal lies in the plane of the original sheet metal stock. Terminals of this type can be described as being complanate in that they are relatively flat and have a thickness which is equal to the thickness of the metal stock from which they were produced. The terminal must be designed such that a spring means is provided to produce the required contact force. Since sheet metal materials are extremely stiff when flexed in their own planes (as opposed to being flexed transversely of their planes), great care must be taken in the design of the terminal to achieve flexure in the self-contained spring means of the terminal. U.S. Pat. Nos. 4,176,895; and 3,215,968 show complanate terminals of the type under discussion and also show how such terminals can be designed to achieve a self-contained spring in the flat terminal for developing the contact force.

The present invention, in accordance with one aspect thereof, is directed to the achievement of an improved flat complanate terminal having self-contained spring means which can be modified to yield a range of contact forces for the finished terminal and/or a pre-selected deflection range. In other words, the invention is directed to the achievement of a flat terminal stamped from metal stock without forming, which can be tailored to use under a wide range of operating conditions.

In accordance with a further aspect thereof, the invention is directed to the achievement of a contact terminal characterized by its having a low and predictable self-inductance characteristic. Every terminal has some inductance effects and under many circumstances these are of little or no significance; for example, where the terminal is used to carry direct current without rapid switching or where the frequency of the alternating current in the circuit is extremely low. However, much modern electronic equipment involves very high frequency alternating current or rapid switching of current in the circuits so that self-inductance effects can be troublesome. Some telephone equipment, for example, has switching times of the order of $10^{-9}$ seconds and under current conditions of these types, the rate of change of the current with time is extremely high notwithstanding the fact that the actual magnitude of the current is relatively low. Such high current change rates then result in self-inductance effects which can, in turn, interfere with the normal operation of the equipment. In general, contact terminals which have sinuous spring portions and a relatively long current path through the contact can prove troublesome from the standpoint of self-induction effects.

One type of contact terminal, in accordance with the invention, is produced by stamping flat sheet metal stock without significant subsequent forming so that all of the parts of the terminal lie in a single plane, the plane of the original sheet metal. The parts of the terminal comprise a yoke portion having extending therefrom a contact arm, a spring arm, and a solder post or the like, for connecting the terminal to other circuits. The contact arm and the spring arm are in side-by-side relationship and a contact portion on one side of the contact arm at its free end engages the terminal pad on a circuit board or other complementary terminal device. A bearing portion is also provided on the end of the contact arm which engages an opposed bearing portion on the end of the spring arm. The contact arm is capable of undergoing flexure when the connector in which the terminal is contained is mated with a complementary part and upon such flexure, the contact arm moves in a direction towards the spring arm. The spring arm is thereby mechanically loaded and stressed so that it develops the necessary reaction force to press the outer end of the contact arm against the circuit board. The spring arm does not serve as a current carrying member, since all of the current flows directly from the contact arm to the solder post and thence to the external circuit. The spring arm can, therefore, be proportioned to perform its purely mechanical function without regard to electrical considerations. The contact arm likewise can be designed and dimensioned with purely electrical considerations in mind and without concern for the matter of spring force.

PRACTICE OF THE INVENTION

Figure 2:
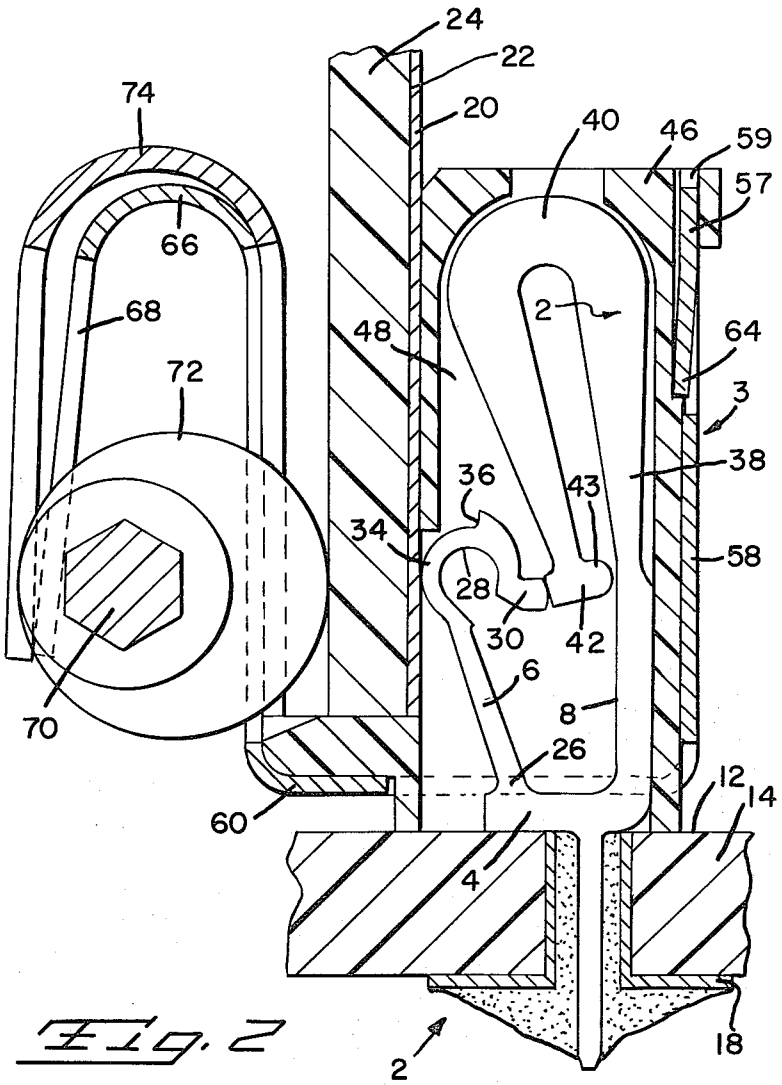
FIG. 2 is a view similar to FIG. 1, showing the positions of the parts when the connector is mated with a circuit board.
Figure 1:
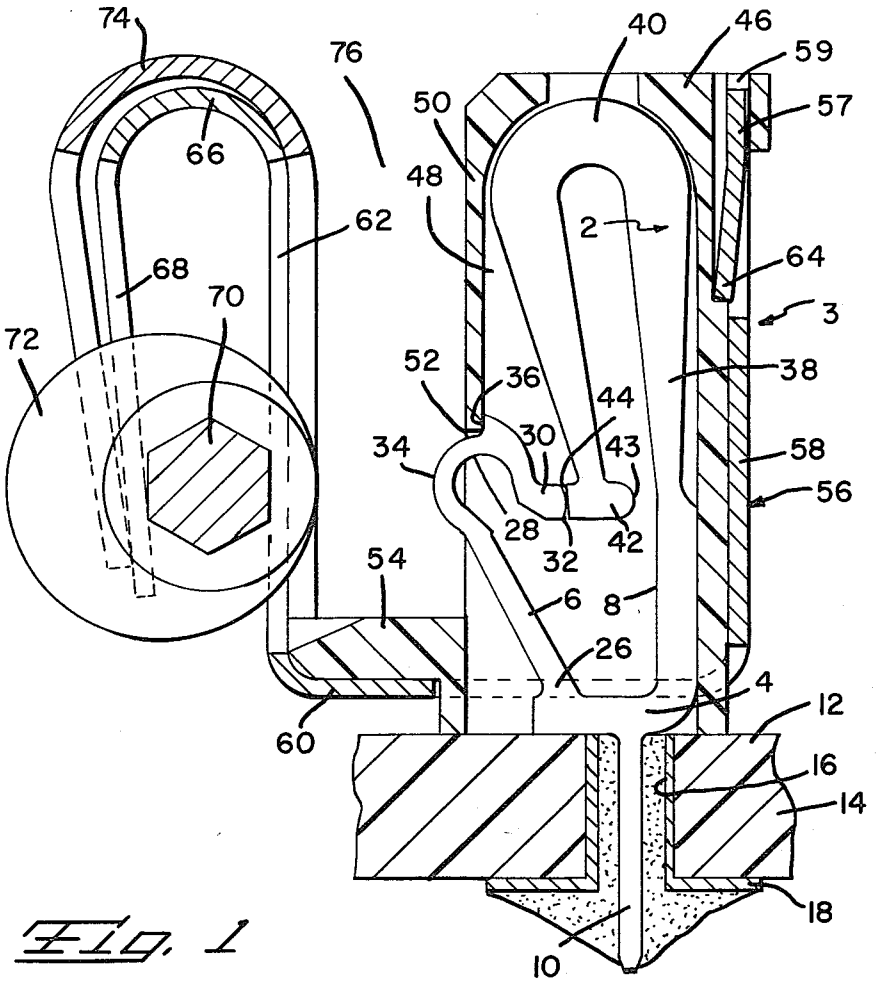
FIG. 1 is a cross-sectional view of a multi-contact electrical connector having contact terminals in accordance with the invention contained therein, this view showing the positions of the parts when the connector is not mated with a complementary circuit board.

Referring first to FIGS. 1 and 2, a terminal 2, in accordance with the invention, serves to connect conductors 18 on the underside of one printed circuit board 14 to conductors 20 on a surface 22 of a smaller printed circuit board 24. The terminal is contained in a housing mounted on the upper surface 12 of circuit board 14 and the terminal has a solder post 10 which extends through an opening 16 in the circuit board and is soldered to the conductor 18, as shown. It will be understood that the connector 3 contains a plurality of terminals on closely spaced centers.

The connector 3 is of the type fully disclosed and claimed in the co-pending application of Dimitry Grabbe et al, Ser. No. 208,734, filed Nov. 20, 1980. It will be understood that contact terminals, in accordance with the invention can be used in a wide variety of types of connectors which may be intended for use with printed circuit boards or with the substrates of integrated circuit packages.

The terminal 2 comprises a yoke portion 4 having extending therefrom a contact arm 6 and a spring arm 8 in side-by-side spaced-apart relationship. These arms extend from the upper edge of the yoke and the previously identified solder tab or post 10 extends from the lower edge of the yoke. The contact arm is integral at its base 26 with the yoke and extends obliquely away from the spring arm to a generally circular free end portion 28. At the end of this circular portion, there is provided an extension 30 which is directed towards the spring arm and the edge 32 of this extension serves as a bearing portion for cooperation with a bearing portion 44 on the spring arm 8. The edge of the circular portion which is outwardly directed, as shown at 34, serves as a contact portion of the terminal and engages the conductor 20 on the circuit board 24. An ear 36 is provided on the circular portion 28 and has an edge which bears against the inside surface of the housing cavity 48 so that the contact arm cannot move leftwardly in a counter-clockwise direction from the position shown in FIG. 1.

The spring arm 8 has a lower portion which is of substantially uniform width and which extends normally of the yoke 4 of the terminal. This lower portion merges with a spring portion 38 which is reversely curved, as shown at 40, and which merges with a depending portion 41, so that the free end 42 of the spring arm is adjacent to the extension 30 of the contact arm. The rightwardly facing edge 43 of the free end of the spring arm serves as a stop, to prevent overstressing. The leftwardly facing edge 44 is normally against the bearing surface edge 32 of the contact arm 6.

The connector 3 comprises an insulating housing 46 having a plurality of side-by-side cavities 48 therein extending upwardly from the lower end of the connector as viewed in the drawing. These cavities are dimensioned snugly to receive the terminals as shown, and the lefthand wall of the housing 50 has an opening therein 52, through which parts of the circular free end portion 28 of the contact arm project. The insulating housing has a leftwardly extending flange 54 which serves as a support for the circuit board 24, as shown in FIG. 2, and this flange also supports, in part, a frame assembly 56 which is assembled to the housing.

The frame assembly is of stamped and formed sheet metal, preferably steel, and is generally channel-shaped having sidewalls 58, 62 and a base 60. The sidewall 58 is disposed against the rightwardly facing surface of the housing and has a lance 64 struck from its upper end portion which is received in a recess in the housing. The frame assembly is also retained on the housing by ear means 57 on the frame which are received in openings 59 in the housing.

The sidewall 62 is reversely bent, as shown at 66, at its upper end to provide a depending arm as shown at 68, which is spaced from the sidewall 62. A cam shaft is supported between the arm 68 and the sidewall 62 as shown at 70, and has spaced-apart eccentric cams 72 mounted thereon. Openings are provided in the sidewall 62, the depending arm 68, and in a spring member 74 to provide clearance for these cams. The shaft 70 is suitably supported by ears (not specifically shown) extending from the frame inwardly and under the shaft and also supported at its ends in the housing, as explained in the above identified application Ser. No. 208,734. It should be mentioned that the shaft 70 is movable in a horizontal direction towards the housing wall 50 so that circuit boards of varying thicknesses can be received in the trough 76 defined by the sidewall 62 and the housing wall 50.

In order to firmly clamp the circuit board against the contact surfaces 34 of the contact arms 6 of the terminals, additional spring means 74 is mounted on the sidewall 62 and the depending arm 68 of the frame 56. This spring 74 may not be required under all the circumstances but can be used when it is desired to have extremely high forces at the electrical interfaces between the contact portions 34 of the terminals and the terminal pads on the circuit board 24.

In use, edge portions of the circuit board are inserted into the trough 76 as shown in FIG. 2, and the shaft 70 is thereafter rotated through an angle of substantially 180° to the position shown in FIG. 2. During such rotation of the shaft, the cam will progressively push the circuit board against the contact terminals and the spring 74 will be flexed as shown, so that it will develop the required clamping force. The contact arm 6 is flexed in a generally clockwise direction as the cam is rotated so that the contact arm pushes the spring arm to the position in FIG. 2. The manner in which the contact arm is flexed and the spring arm 8 is stressed when the parts are in the positions of FIG. 2 is discussed more fully below.

Figure 3:
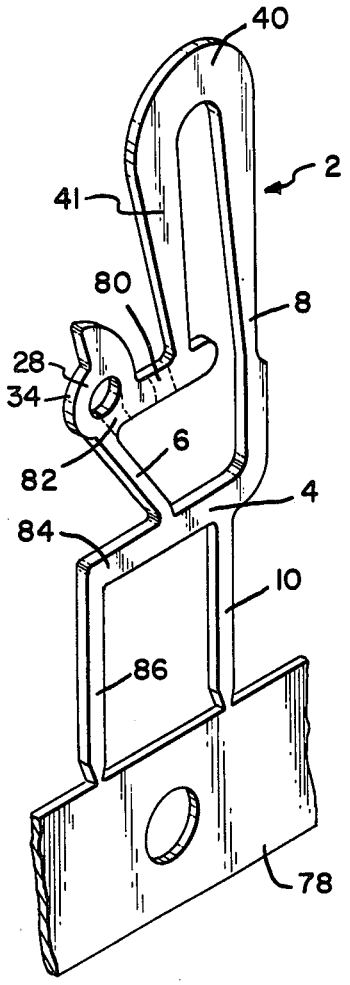
FIG. 3 is a perspective view of a terminal in the as stamped condition.

Terminals in accordance with the invention can be produced of any suitable material by simply removing material from flat stock metal. The removal of the material will ordinarily be carried out by a simple stamping operation to produce terminals in strip form, as shown in FIG. 3, however, such terminals might, under some circumstances, be manufactured by chemical etching of the strip. In any event, the finished terminal will have all of its parts lying in the plane of the original stock metal so that the cantilever beams, the contact arm, and the spring arm, are relatively stiff, although they are flexible.

Figure 4:
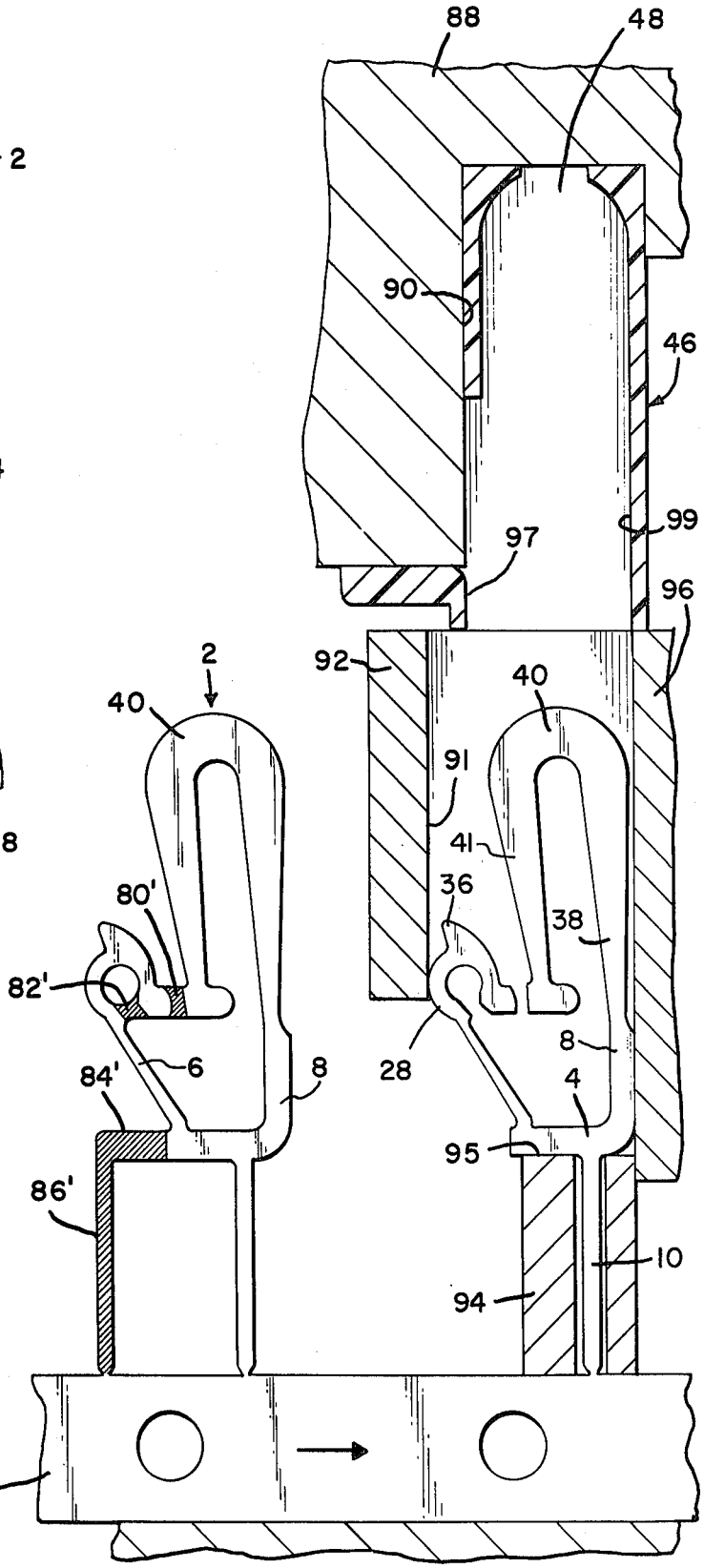
FIGS. 4–6 illustrate the essential steps involved in the operations of severing individual terminals from the strip and inserting the terminals into a connector housing.

Referring now to FIGS. 3–6, the terminals as stamped are integral with a continuous carrier strip 78 and in the as stamped condition, differ from the terminals as installed in the housing in that each terminal has an extension 84 of the yoke 4 and an additional solder post 86. Also, the end of the contact arm is integral with the end of the spring arm, as shown at 80, and the short lower portion on the end of the contact arm extends through a complete circle, as shown at 82. The material indicated at 80 and 82 is removed prior to insertion of the terminal into the housing cavity 48. As shown at 80', 82' FIG. 4. The yoke extension 84' and the second solder post 86' may also be removed, as indicated in FIG. 4. Alternatively, the yoke extension and second solder leg may remain on the terminal and the tab 10 may be removed. When the terminals are provided on closely spaced centers, alternate terminals may thus have the leg 10 removed and the remaining terminals have the leg 86 removed so that a grid hole pattern in the circuit board can be provided for more convenient spacing and location of the conductors on the circuit board.

Terminals 2 are installed in the housing 46 in the general manner shown in FIGS. 4–6, and preferably by means of insertion machinery having the elements described below for guiding and inserting the terminals. The housing 46 is supported in a housing support 88 that has a recess 90 in which the housing is supported with the open lower end of a cavity 48 disposed above the leading terminal of the strip 78. At the insertion station, a contact arm flexing and guiding tool 92 moves against the contact portion 34 of the contact arm 6 and an inserter 94 moves into surrounding relationship with the solder tab 10 of the terminal. The upper surface 95 of this inserter thus bears against the lower edge of the yoke portion of the terminal so that when the inserter 94 moves upwardly, the terminal will be pushed into the cavity 48. Prior to such movement of the inserter, the flexing and guiding tool 92 moves rightwardly from the position of FIG. 4 to the position of FIG. 5, in which the righthand surface 91 of this tool is coplanar with the adjacent surface 97 of the housing.

Figure 5:
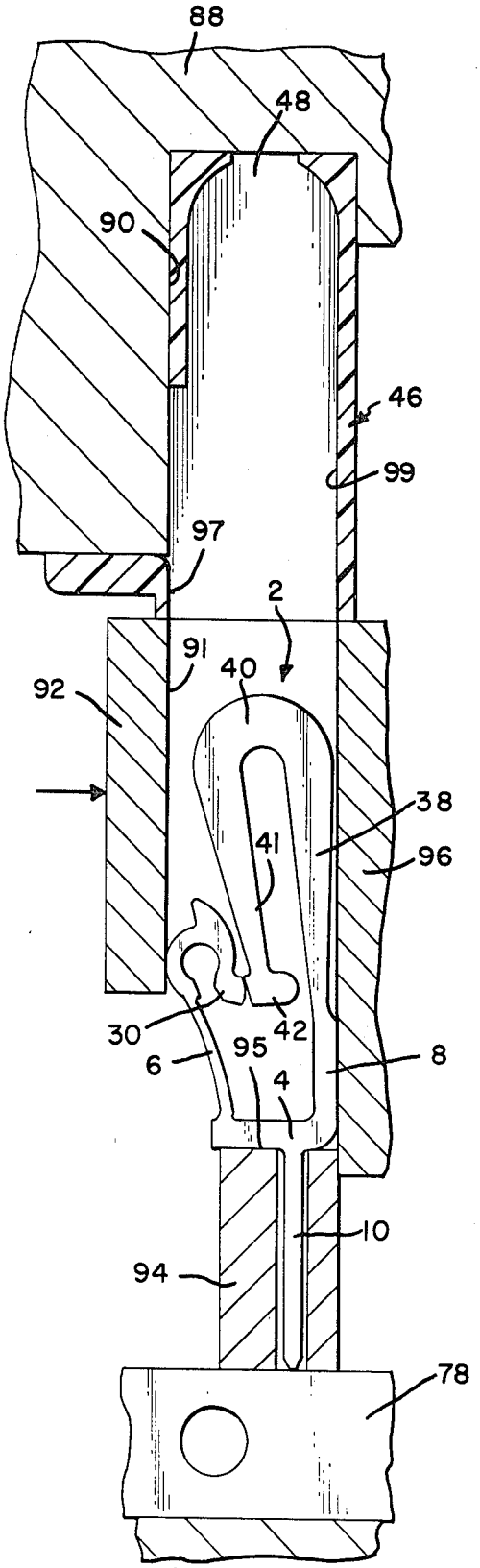
Figure 6:
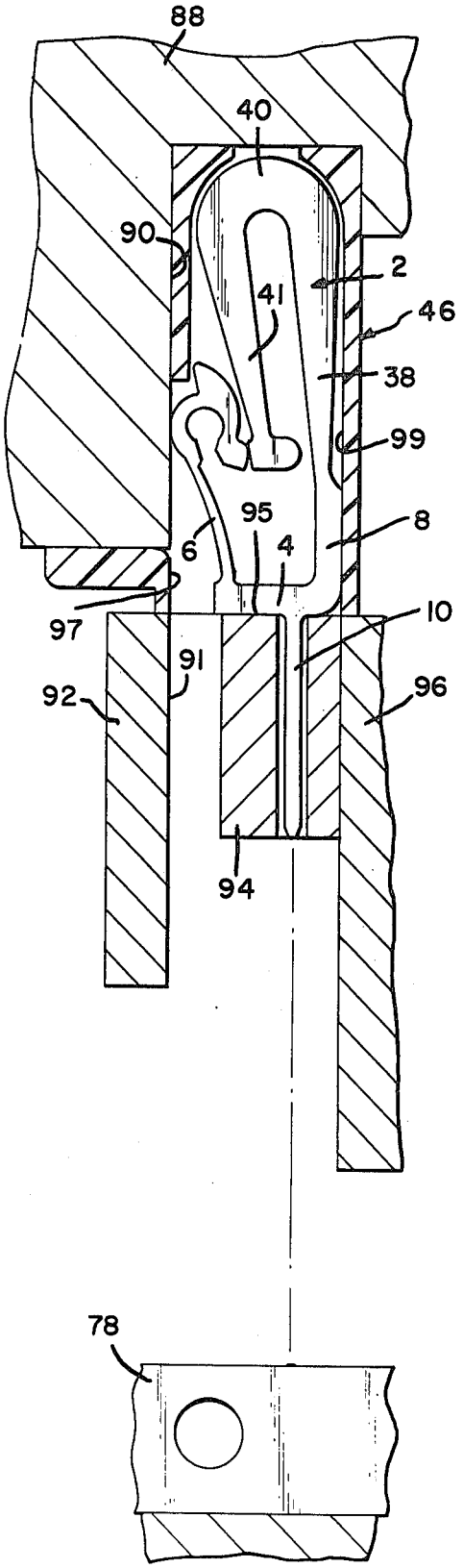

When the contact arm 6 is flexed rightwardly by the flexing tool 92, the bearing surface 32 moves against the bearing surface 44 and the depending section 42 of the spring arm is thereafter moved rightwardly, as viewed in FIGS. 4 and 5, along with the contact arm until the parts are in the positions of FIG. 5. The bearing surface 43 on the end of the spring arm will not engage the edge of the portion 38 of the arm under normal circumstances, but the extension 42 of the spring arm and the bearing surface 43 will prevent overstressing if the spring arm is moved rightwardly beyond the position shown in FIG. 5. The terminal is sheared from the carrier strip 78 by a suitable shearing means when the parts are in the position of FIG. 5 and thereafter the inserter 94 moves upwardly from the position of FIG. 6. A suitable guide means 96 is provided against the righthand edge of the terminal and in alignment with the surface 99 of the cavity so that the terminal will move smoothly into the cavity 48. When the tooling is then removed from beneath the terminal and the housing is removed from the housing support 88, the contact arm 6 will move leftwardly until the ear 36 is against the internal surface of the cavity, as shown in FIG. 1.

When the terminal is installed in the cavity 48 of the housing as shown in FIG. 1, both of the arms 6, 8 are in a resiliently flexed condition. The spring arm 8 is flexed in a first direction, that is rightwardly in FIG. 1 and away from the normal position of the contact arm 6. The contact arm 6 is flexed in a second direction, that is, leftwardly as viewed in FIG. 1. This flexure of the contact arm is imparted to the contact arm by the spring arm 8 which has a tendency to return to its normal position and move leftwardly from the position shown in FIG. 1. The contact arm 6 is restrained against further leftward movement from the position of FIG. 1 by the stop ear 36.

It will be apparent from the foregoing description that the electrical function of the terminal is performed primarily by the contact arm 6 in that the current will flow from the contact portion 34 along this arm to the yoke 4 and through the solder post 10 to the conductor 18. The contact arm is substantially straight and extremely short, so that inductance effects will be minimized. Current will not tend to flow across the bearing portions 32, 44 and through the spring arm because of the fact that this current path would present a higher resistance. The contact arm is flexed when the circuit board 24 is positioned against the surface 50 of the housing but its flexure makes only a minor contribution to the contact force developed in the electrical interface of the terminal and the circuit board in FIG. 2. Most of the contact force is developed in the spring arm and is transmitted to the contact arm through the upper portion 28 of the contact arm directly to the terminal pad on the circuit board 24. Thus, the intermediate shank portion of this contact arm is not subjected to the contact force which is present at the electrical interface. The spring arm can, of course, be designed to provide optimum properties and characteristics for the particular use to which the connector will be put. If extremely high contact forces are desired, this spring arm can be made relatively stiff so that it will develop such high forces. Alternatively, if a contact force of limited magnitude is desired, the contact force can be reduced by redesigning the spring arm of the terminal.

While the principles of the invention will be apparent from the foregoing discussion, the following discussion of the performance of a specific terminal in accordance with the invention will provide a deeper understanding of the invention and the manner in which terminals can be designed specifically for particular applications. The following discussion is based on studies of a terminal produced from phosphor bronze stock metal having a thickness of 0.25 mm and in a relatively hard temper. The terminal had an overall height of 14.8 mm and a width of about 4.9 mm. The dimensions of the parts in the terminal were selected to produce a contact force of about 600 gms.

Figure 7:
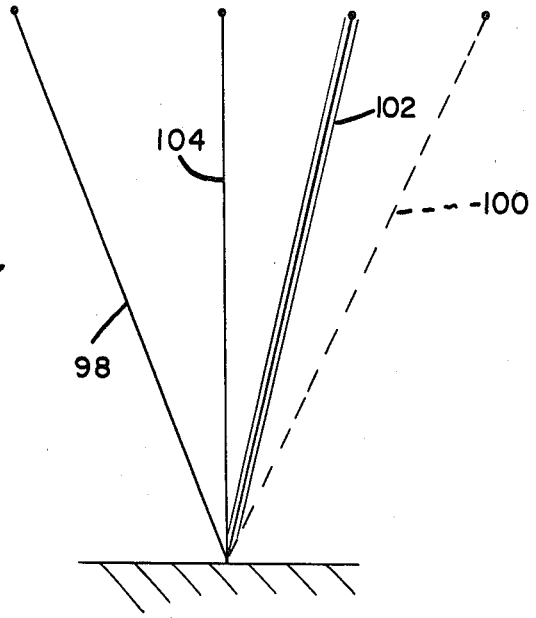
FIG. 7 is a diagram which illustrates the deflection of the contact arm of the terminal.

FIG. 7 is a diagram which shows the relative positions of the upper end of the contact arm at different stages of the assembly operation in which the terminal is inserted into the cavity 48. In this view, the line 98 indicates the position of the contact arm 6 prior to flexing of this arm inwardly towards the spring arm, in other words, the position of the arm, as it appears in FIG. 4 of the drawing. The line 100 denotes the position of the contact arm when the parts are in the position of FIG. 6 or FIG. 2, that is, when the contact arm is flexed rightwardly to its extreme position. When this arm is flexed by the flexing tool 94, the material in the arm yields and plastically flows so that the arm has a tendency to return to the position indicated by the line 102 as the result of springback. However, when the connector housing is removed from the housing support 88, the spring arm pushes the contact arm leftwardly beyond its normal position, as indicated in 104. The spring arm is of course flexed rightwardly when the parts are moved to the position of FIG. 5 and it has a tendency to return to its normal position, and it is this tendency of the spring arm to return to its normal position that pushes the contact arm to the position indicated by the line 104.

Figure 8:
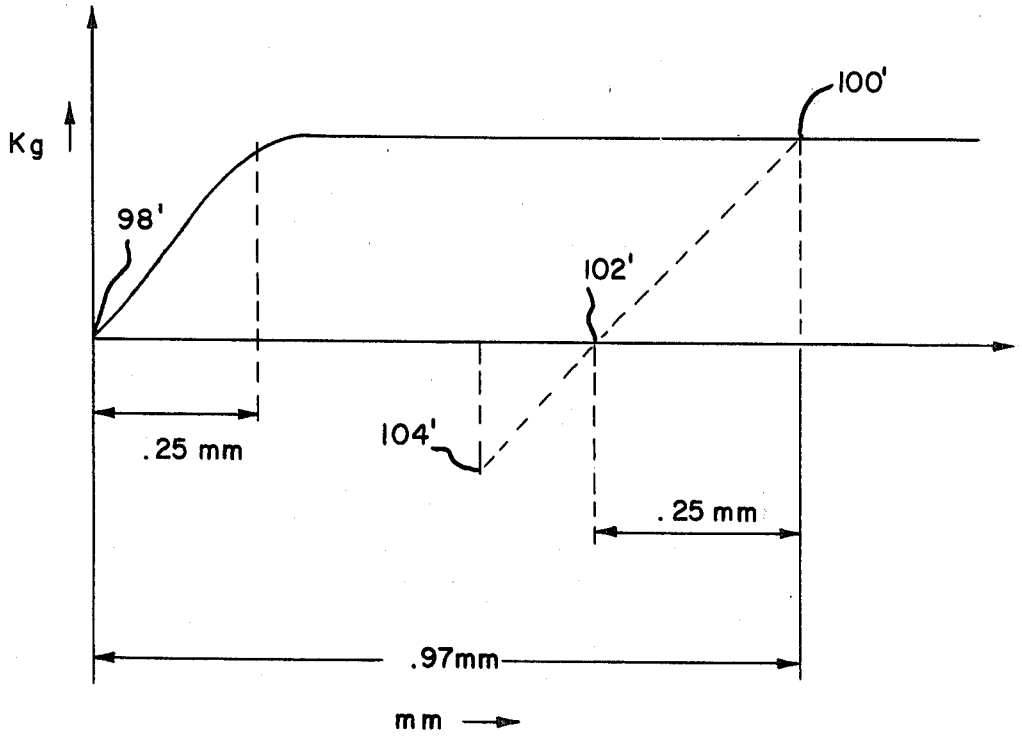
FIG. 8 is a force/deflection diagram illustrating the functioning of the contact arm of the terminal.
Figure 9:
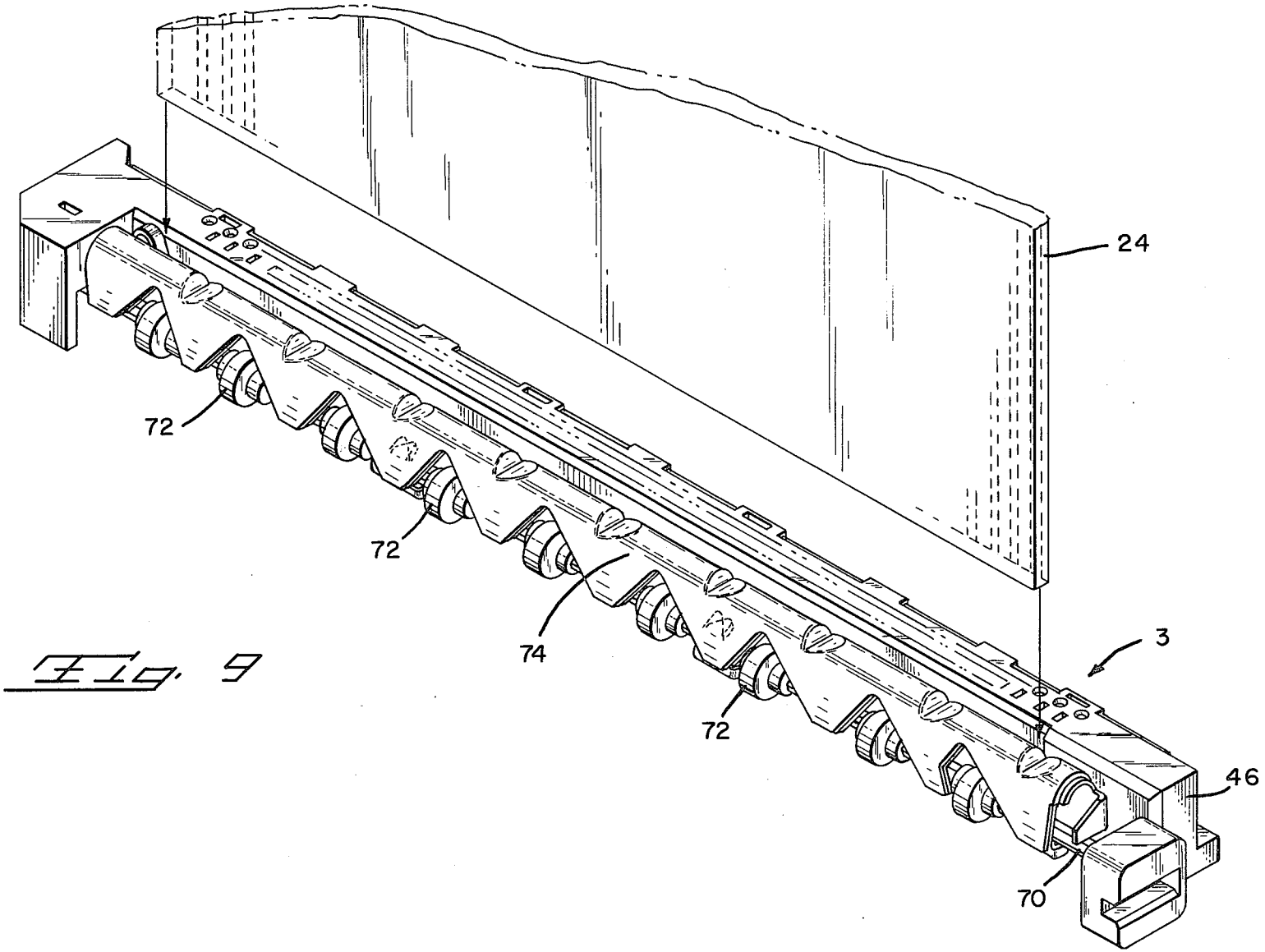
FIGS. 9 and 10 are perspective views of the connector in assembled condition, FIG. 9, and with the parts exploded from each other, FIG. 10.
Figure 10:
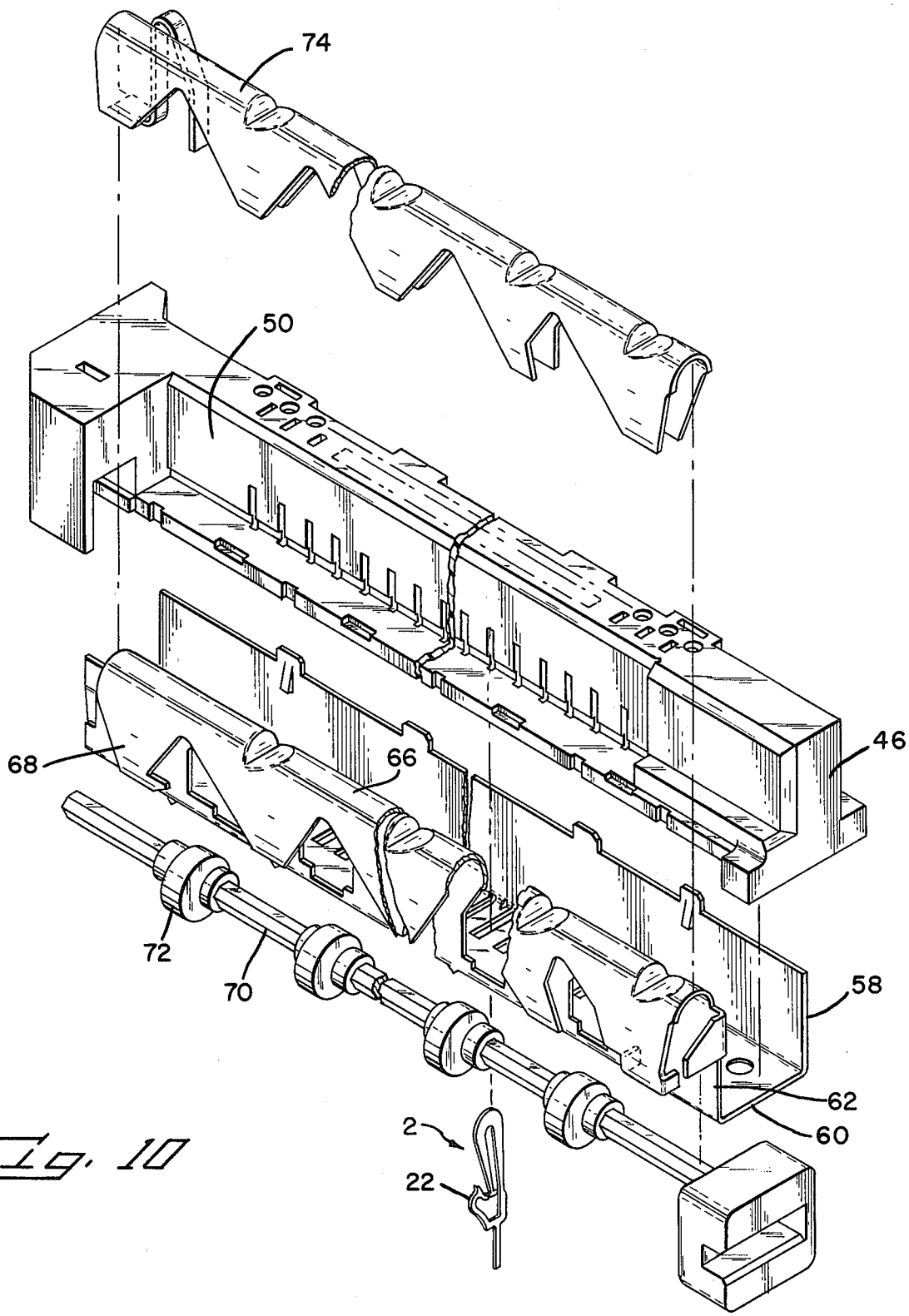

FIG. 8 is a force travel diagram showing the position of the upper end of the contact arm during the assembly process. The reference numerals 98, 100, 102, 104 have been applied to FIG. 8, with prime marks, so that the curve shown in FIG. 8 can be correlated with the arm positions shown in FIG. 7. As shown in FIG. 8, the upper end of the arm is moved a total of 0.97 mm when it is flexed from the position of FIG. 4 to the position of FIG. 5 and during such flexure, the load remains substantially constant after it has risen to a plateau value.

When the connector is removed from the connector support 88, the upper end of the contact arm moves leftwardly past the condition of no load, as shown at 102', and is flexed in a manner such that it is loaded in the opposite direction, as indicated at 104'.

The significance of the diagram of FIG. 8 is that the contact arm is flexed leftwardly from its normal position in the assembled connector so that when the circuit board is inserted into the trough 76 and clamped against the surface 50, the initial portion of the travel of the contact arm merely has the effect of unloading the stresses in the arm and returning it to its unstressed position, as indicated by the line 102 in FIG. 7. Thereafter, the arm is flexed rightwardly to the position indicated by the line 100 in FIG. 7.

The fact that the contact arm and the spring arm are both in a flexed condition and are resiliently biased towards each other results in the capability in the contact arm for an increased amount of travel in normal usage, as compared in the amount which would be obtainable if the contact arm were not flexed leftwardly when it is in its FIG. 1 position and, therefore preloaded against the lower end of the spring arm. The spring arm can, of course, withstand the flexure which it must undergo in the ordinary use of the connector by virtue of its substantial mass and its dimensions.

The specific terminal in accordance with the invention which has been described above has a free end 28 on the contact arm 6 which is capable of rotation relative to the shank portion of the contact arm when the load, the contact force, is applied against the contact portion 34 and the reaction force is applied against the bearing portion 32 by the spring arm. The capability for this rotation increases the overall range of movement of the contact area 34 rightwardly, as viewed in the drawing, when the circuit board is mated with the connector. In other words, the shank portion of the contact arm which extends from the base portion 26 to the free end undergoes flexure when the contact arm is stressed and this flexure of the arm results in some movement of the contact zone rightwardly from the position of FIG. 1. In addition, the rotation of the circular upper end of the contact arm also results in some rightward movement of the contact portion 34 from the position of FIG. 1 and the total amount of movement of the contact portion 34 is therefore the sum of the movement contributed by the shank portion of the contact arm and the portion contributed as the result of the rotation of the circular upper portion of the contact arm.

This characteristic of the disclosed embodiment is highly advantageous in that it permits the designer of a specific terminal to achieve a greater amount of movement of the contact portion than would be obtainable if all of the movement were simply a result of flexure of the shank portion of the contact arm. Additionally, the rotation of the circular upper portion of the contact arm contributes to the achievement of a wiping motion on the contact surfaces since the actual zone of contact moves relatively over the zone of contact on the circuit board as the circuit board is clamped in the connector.

Terminals in accordance with the invention can be plated with a conductive metal as desired and as indicated by the environment of the intended use. Tin plating or plating with a tin-lead alloy may be satisfactory under many circumstances, particularly in view of the fact that high contact forces can be obtained from the terminal if desired. Gold plating may be used if an extremely low resistance is required. If terminals in accordance with the invention are used under cryogenic conditions, a plating of indium or pure tin may be used.

We claim:

1. An electrical contact terminal of the type having a contact portion for engaging a terminal pad on a circuit board or the like, and spring means for maintaining said contact portion against said terminal pad, said terminal being characterized in that:

said terminal has a yoke portion, a contact arm, and a spring arm, said contact arm and said spring arm extending from said yoke portion and being side-by-side, said contact arm having an electrical contact portion and a contact arm bearing portion, said electrical contact portion and contact arm bearing portion being spaced from said yoke portion and facing in opposite lateral directions, said contact arm bearing portion being directed towards said spring arm, said spring arm having a spring arm bearing portion spaced from said yoke portion and directed towards, and in alignment with, said contact arm bearing portion, said contact arm comprising a cantilever beam having a free end portion, said electrical contact portion and said contact arm bearing portion being proximate to said free end portion, an extension on said free end portion of said contact arm extending towards said spring arm, said contact arm bearing portion being on the end of said extension, said terminal being complanate and having been manufactured from flat stock metal by removing portions of the stock metal, said arms and said yoke portion having extensive parallel side surfaces and narrow edge surfaces extending between said side surfaces, said bearing portions and said electrical contact portion being on said edge surfaces whereby, upon application of a contact force against said contact portion of said contact arm when said terminal pad is moved against said contact portion, said contact arm is moved towards said spring arm, and said spring arm is flexed and develops contact force for maintaining said contact portion against said terminal pad.

2. An electrical contact terminal as set forth in claim 1, said free end portion of said contact arm extending arcuately towards said spring arm.

3. An electrical contact terminal as set forth in claim 1, said free end portion of said contact arm being generally circular.

4. An electrical contact terminal as set forth in either of claims 1 or 3, said spring arm having a circuitous spring portion.

5. An electrical contact terminal as set forth in claim 4, said circuitous spring portion extending beyond said contact arm and being curved back towards said yoke portion.

6. An electrical contact terminal as set forth in claim 4, said terminal having been manufactured by stamping said stock metal.

7. An electrical contact terminal as set forth in claim 1, said contact arm and said spring arm being in a flexed condition and being resiliently biased towards each other, said bearing portions being against each other.

8. An electrical contact terminal of the type having a contact portion for engaging a terminal pad on a circuit board or the like, and spring means for maintaining said contact portion against said terminal pad, said terminal being characterized in that:

said terminal has a yoke portion, a contact arm, and a spring arm, said contact arm and said spring arm extending from said yoke portion and being side-by-side, said contact arm having an electrical contact portion and a contact arm bearing portion, said electrical contact portion and contact arm bearing portion being spaced from said yoke portion and facing in opposite lateral directions, said contact arm bearing portion being opposed to said spring arm, said spring arm having a spring arm bearing portion spaced from said yoke portion and directed towards, and in alignment with, said contact arm bearing portion, said terminal being complanate and having been manufactured from flat stock metal by removing portions of the stock metal, said arms and said yoke portion having extensive parallel side surfaces and narrow edge surfaces extending between said side surfaces, said bearing portions and said electrical contact portion being on said edge surfaces whereby, said terminal being contained in a cavity in a connector housing, both of said arms being in a flexed condition with said bearing portions against each other, said spring arm being resiliently flexed in a first direction which extends away from said contact arm, said contact arm being flexed by said spring arm in a second direction which is the opposite direction with respect to said first direction, and stop means in said housing limiting flexure of said contact arm in said second direction whereby, upon application of a contact force in said first direction against said contact portion of said contact arm, when said terminal pad is moved against said contact portion, said contact arm is moved in said first direction towards said spring arm, and said spring arm is flexed by an additional amount in said first direction and develops contact force for maintaining said contact portion against said terminal pad.

9. An electrical contact terminal as set forth in claim 8, said spring arm having a circuitous spring portion.

10. An electrical contact terminal as set forth in claim 9, said circuitous spring portion extending beyond said contact arm and being curved back towards said yoke portion.

* * * * *